United States Patent [19]

Küpper

[11] Patent Number: 4,772,174

[45] Date of Patent: Sep. 20, 1988

[54] BOBBIN TRANSPORTING DEVICE

[75] Inventor: Wilheim Küpper, Wegberg, Fed. Rep. of Germany

[73] Assignee: W. Schlafhorst & Co., Monchen-Gladbach, Fed. Rep. of Germany

[21] Appl. No.: 867,798

[22] Filed: May 23, 1986

[30] Foreign Application Priority Data

May 25, 1985 [DE] Fed. Rep. of Germany ..... 3518906

[51] Int. Cl.[4] ..... D01H 9/00

[52] U.S. Cl. ..... 414/416; 198/487.1; 198/465.2; 242/35.5 A

[58] Field of Search ..... 414/416, 226; 198/487.1, 803.12, 470.1, 803.7, 465.1, 465.2, 433, 426, 427; 242/35.5 A

[56] References Cited

U.S. PATENT DOCUMENTS

| | | | |
|---|---|---|---|
| 2,431,265 | 11/1947 | Madsen et al. | 414/416 X |
| 2,646,226 | 7/1953 | Gamble | 242/35.5 A |
| 2,675,184 | 4/1954 | Abbott et al. | 242/35.5 A |
| 2,712,405 | 7/1955 | Rockcastle | 414/416 X |
| 3,456,811 | 7/1969 | Mahoney et al. | 414/416 |
| 3,788,054 | 1/1974 | Houssmann et al. | 198/487.1 X |
| 4,036,353 | 7/1977 | Suter | 242/35.5 A X |
| 4,144,961 | 3/1979 | Kasahara et al. | 242/35.5 A X |
| 4,147,250 | 3/1979 | Schulz | 198/465.2 |
| 4,363,204 | 12/1982 | Ohude et al. | 414/416 X |
| 4,569,218 | 2/1986 | Baker et al. | 414/226 X |
| 4,571,931 | 2/1986 | Kupper | 242/35.5 A X |
| 4,576,341 | 3/1986 | Matsui et al. | 242/35.5 A |
| 4,586,668 | 5/1986 | Mori | 242/35.5 A |
| 4,595,152 | 6/1986 | Matsui et al. | 242/35.5 A |

*Primary Examiner*—Kenneth J. Dorner
*Assistant Examiner*—Thomas A. Rendos
*Attorney, Agent, or Firm*—Herbert L. Lerner; Laurence A. Greenberg

[57] ABSTRACT

A bobbin transporting device for transporting bobbins from a spinning machine to an automatic winding machine includes at least one bobbin collecting conveyor disposed at the spinning machine, trays for accomodating bobbins in an upright position, a transport path for moving the trays back and forth between the spinning machine and the automatic winding machine, a tray loading device disposed at the spinning machine for loading the trays from the at least one bobbin collecting conveyor at the spinning machine, at least one synchronized bobbin conveyor disposed at the automatic winding machine, and a tray unloading device for unloading bobbins from the trays to the at least one bobbin conveyor.

12 Claims, 7 Drawing Sheets

VIII
VIII

FIG. 6
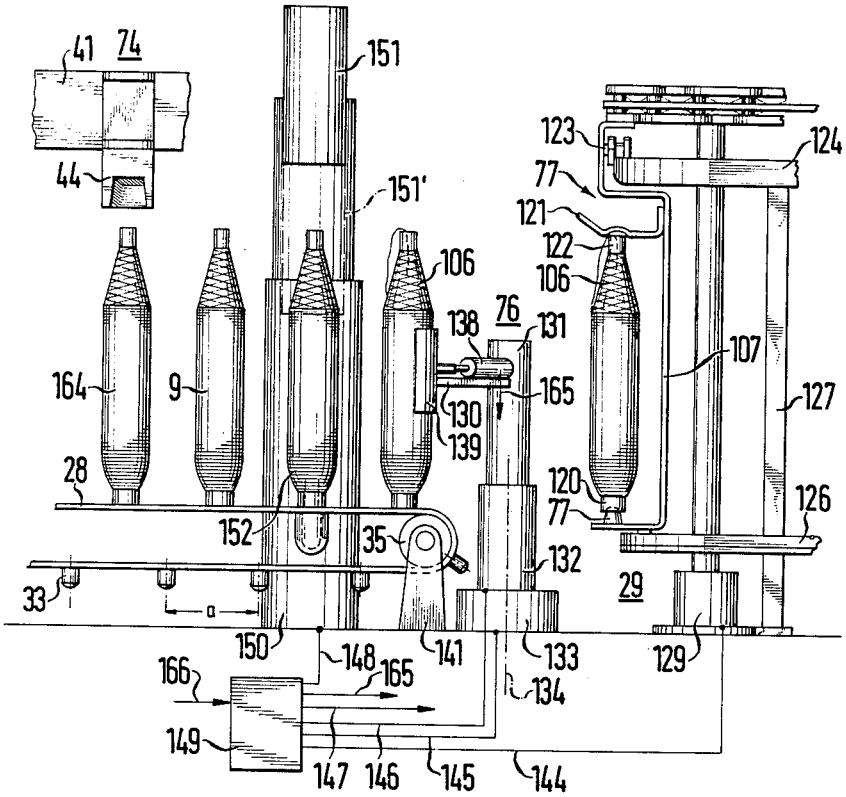
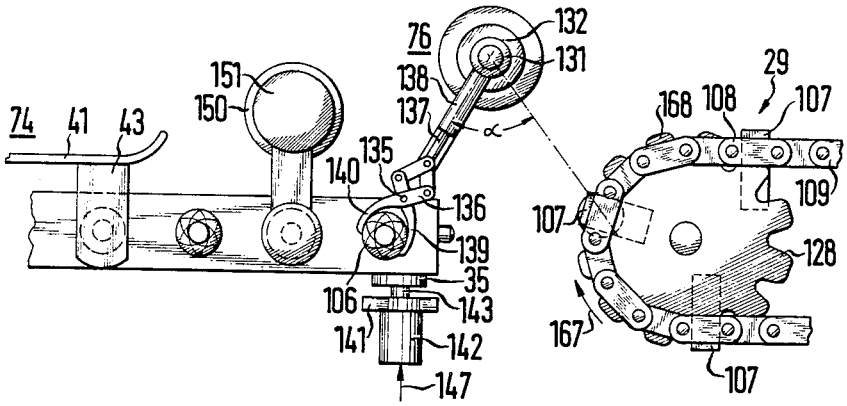
FIG. 7

FIG. 8
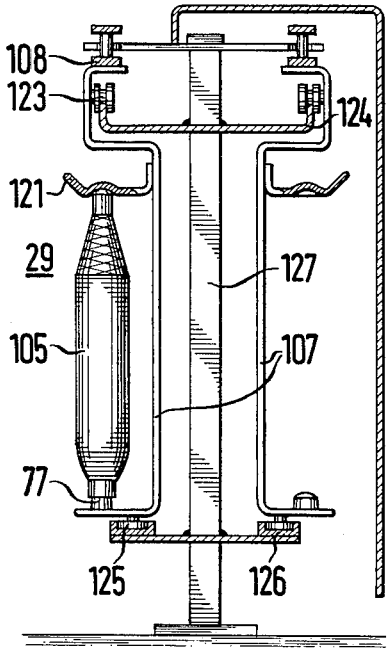
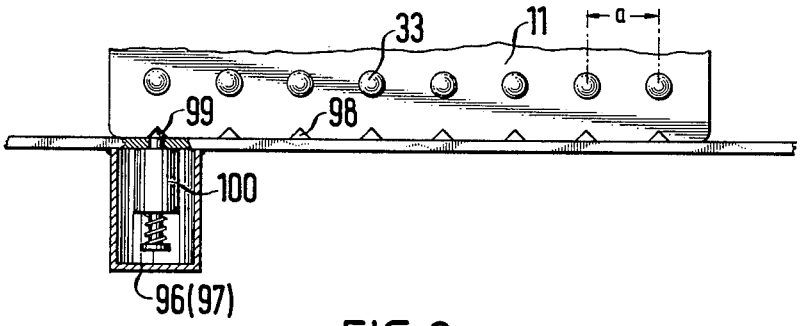
FIG. 9

FIG.10
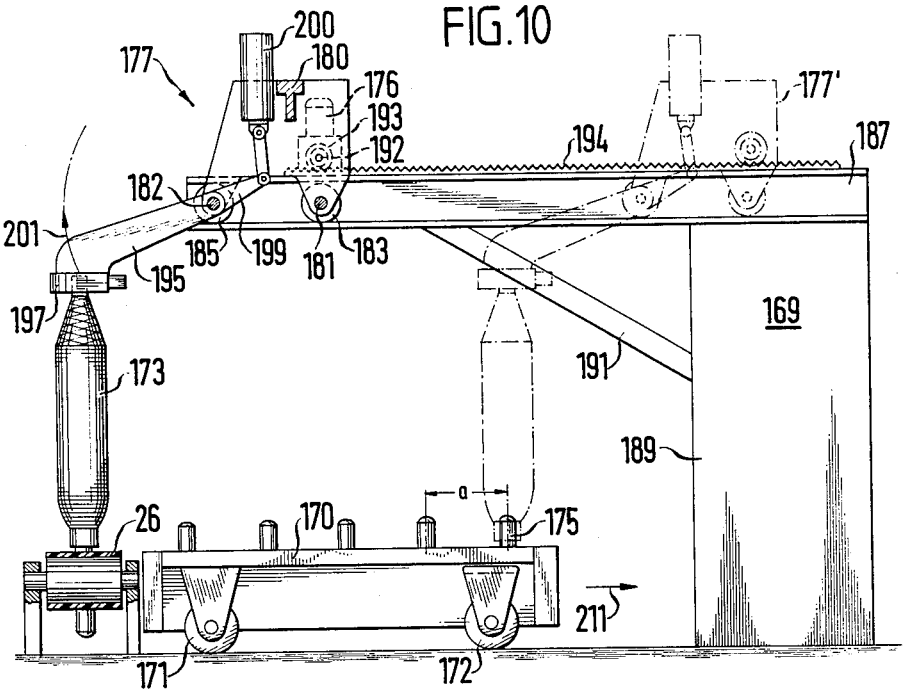
FIG.12
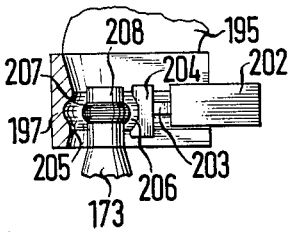
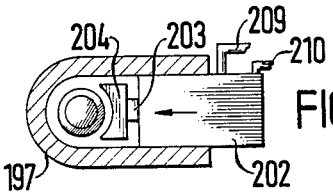
FIG.13
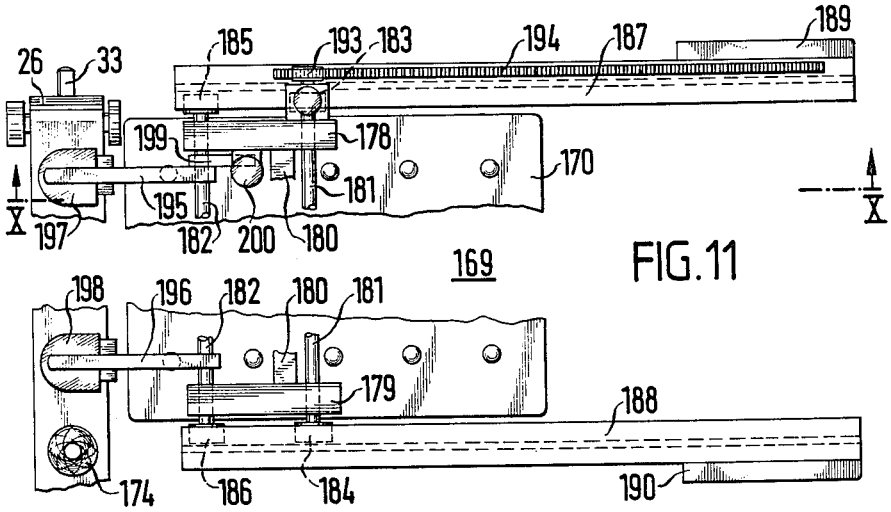
FIG.11

BOBBIN TRANSPORTING DEVICE

The invention relates to a bobbin transporting device for transporting bobbins from a spinning machine to an automatic spool winding machine.

In conventional devices of this type, problems occur during the transport of bobbins, such as lack of visual control, slow circulation, problematical transfer of bobbins, damage to bobbins and difficult storage of bobbins.

It is accordingly an object of the invention to provide a bobbin transporting device which overcomes the hereinafore-mentioned disadvantages of the heretofore-known devices of this general type, to move the bobbins orderly from the spinning machine to the automatic winding machine in predetermined groups always having the same number, in order to closely adjust and match the work cycle of both machines to each other, and also to create the possibility of providing special treatments of the bobbins group after group, before they reach the automatic winding machine.

With the foregoing and other objects in view there is provided, in accordance with the invention, a bobbin transporting device for transporting bobbins from a spinning machine to an automatic winding machine, comprising at least one bobbin collecting conveyor disposed at the spinning machine, trays for accomodating bobbins standing in an upright position, a transport path for moving the trays back and forth between the spinning machine and the automatic winding machine, a tray loading device disposed at the spinning machine for loading the trays from the at least one bobbin collecting conveyor at the spinning machine, at least one synchronized bobbin conveyor disposed at the automatic winding machine, and a tray unloading device for unloading bobbins from the trays to the at least one bobbin conveyor.

Trays which are filled with bobbins disposed in order, offer various advantages. They guarantee visual control for the circulating bobbins as well as rapid and problem-free transfer of the bobbins, while avoiding damage to the bobbins and facilitating intermediate storage and special treatment of the bobbins, because the trays can be stacked on top of each other or can be inserted in tiers on treatment devices, storage containers and the like; transporting errors are easily detected, and if unexpected damage, position changes, insufficient windings or other shortcomings do occur, they are much more easily recognized.

In accordance with another feature of the invention, the transport path includes one slide surface for transporting the trays in one direction and another slide surface for returning the trays.

In the most simple case, and especially if the spinning machine stands near the automatic winding machine, the slide surfaces form a closed loop. However, it is also possible to conduct the slide surface for the transport away from the spinning machine to an intermediate storage facility, or to a bobbin treatment station.

In accordance with a further feature of the invention, there is provided at least one drive device for the trays at the transport path and/or tray loading device and/or tray unloading device. Such a drive device can be programmed to adjust its activities to the speed of the tray loading and/or tray unloading devices. The drive device can utilize gravitational forces, but the use of another drive force is preferable.

In accordance with an added feature of the invention, the at least one bobbin collecting conveyor at the spinning machine, the at least one synchronized bobbin conveyor and the trays all have bobbin mounting pins disposed thereon being mutually spaced apart by a given center distance, and the tray loading and tray unloading devices each include a plurality of mutually operating bobbin carrying heads being mutually spaced apart by the given center distance.

In accordance with an additional feature of the invention, the at least one of the tray loading and unloading devices include a strong, flexible endless band standing on edge, traverses fastened to the endless band and mutually spaced apart at the given center distance, bobbin carrying heads each being disposed on a respective one of the traverses, means for raising and loweing the bobbin carrying heads, tube clamping devices each being disposed on a respective one of the traverses, and means for releasing bobbin tubes from the tube clamping devices. The feature of having equal spacing assures the simultaneous moving and transporting of several bobbins together.

A transport band of this type can be advanced in steps according to a program, so that preferably several bobbin carrying heads can accept and discharge several bobbins simultaneously.

In accordance with again another feature of the invention there are provided rails and means for relieving load or weight from the endless band in the form of rollers each being disposed at the bottom of a respective one of the traverses for running on one of the rails, and guide elements each being disposed at the top of a respective one of the traverses for engaging in or around another of the rails and preventing tipping.

If these traverses are properly fastened to the band, such as along a vertical line, it is possible to deflect the band with a relatively small radius, while the rails on which the traverses are guided have a greater radius at the deflection regions, so that the change of direction causes no problems.

In accordance with again a further feature of the invention, the transport path includes one slide surface for transporting the trays in one direction and another slide surface for returning the trays and the at least one synchronized bobbin conveyor is a bobbin receiving device, and including at least one first bobbin receiving station disposed above the at least one bobbin collecting conveyor at the spinning machine, a first bobbin discharge station disposed above the the one slide surface, a second bobbin receiving station disposed above the one slide surface, and a second bobbin discharge station disposed above the bobbin receiving device, and at least one of the tray loading and unloading devices includes means for moving the endless band thereof in steps equal to the given center distance as a unit from one of the bobbin receiving stations to one of the bobbin discharge stations.

The tray loading or unloading device can load a corresponding number of bobbins at the same time. In practice, as many bobbins are loaded simultaneously as there are mounting pins provided in one row on the tray.

In accordance with again an added feature of the invention, besides the bobbin receiving device, the synchronized bobbin conveyor also includes an additional bobbin conveyor having bobbin receiving elements, and including a bobbin transfer device for individually transferring bobbins from the bobbin receiving device to the bobbin receiving elements, and means for moving the bobbin receiving device past the bobbin transfer device in steps equal to the given center distance. This additional conveyor as a rule is the one which directly supplies the individual winding stations of the automatic winding machine.

In accordance with again an additional feature of the invention, at least one of the tray loading and unloading devices includes at least one tray pushing or arresting device, and means for controlling the pushing or arresting device according to the given center distance. Such a pushing and/or arresting device most advantageously works in conjunction with the tray loading or unloading device. The work cycles are performed alternatingly, in step with each other.

In accordance with still another feature of the invention, the additional bobbin conveyor supplies bobbins to winding stations of the automatic winding machine, and the additional bobbin conveyor includes a conveyor chain having chain links and bobbin carriers connected to the chain links, the bobbin carriers each including one of the bobbin receiving elements for a foot of a bottom tube and a flexible or elastic clamping element for a top of a bobbin tube. In this way a tube of the bobbin is clamped by spring action, so that simple gripping devices can be used for supplying and unloading the conveyor.

In accordance with still a further feature of the invention, at least one of the tray loading and unloading devices include a travelling carriage having mutually operable bobbin carrying heads.

In accordance with a concomitant feature of the invention, the travelling carriage includes a controllable shaft, and arms connected to the controllable shaft, the bobbin carrying heads being disposed on the arms and the bobbin carrying heads including controllable tube sleeve clamping devices.

Other features which are considered as characteristic for the invention are set forth in the appended claims.

Although the invention is illustrated and described herein as embodied in a bobbin transporting device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 6 is a fragmentary, side-elevational view of a bobbin receiving device with two bobbin conveyors and a bobbin transfer device;

FIG. 7 is a fragmentary, top-plan view of the bobbin conveyors shown in FIG. 6 and the bobbin transfer device;

FIG. 8 is a cross-sectional view of the bobbin conveyor shown at the right side of FIGS. 6 and 7, taken along line VIII—VIII in FIG. 1, in the direction of the arrows;

FIG. 9 is an enlarged, fragmentary, partially cross-sectional, top-plan view of an arresting device;

FIG. 10 is a side-elevational view of an alternate version of a tray loading device, taken along the line X—X in FIG. 11, in the direction of the arrows;

FIG. 11 is a fragmentary, top-plan view of the tray loading device shown in FIG. 10;

FIG. 12 is a fragmentary, diagrammatic, longitudinal-sectional view of a bobbin carrying head of the tray loading device shown in FIGS. 10 and 11; and FIG. 13 is a fragmentary, diagramnatic, cross-sectional view of the bobbin carrying head of the tray loading device shown in FIGS. 10 and 11.

Figure 1:
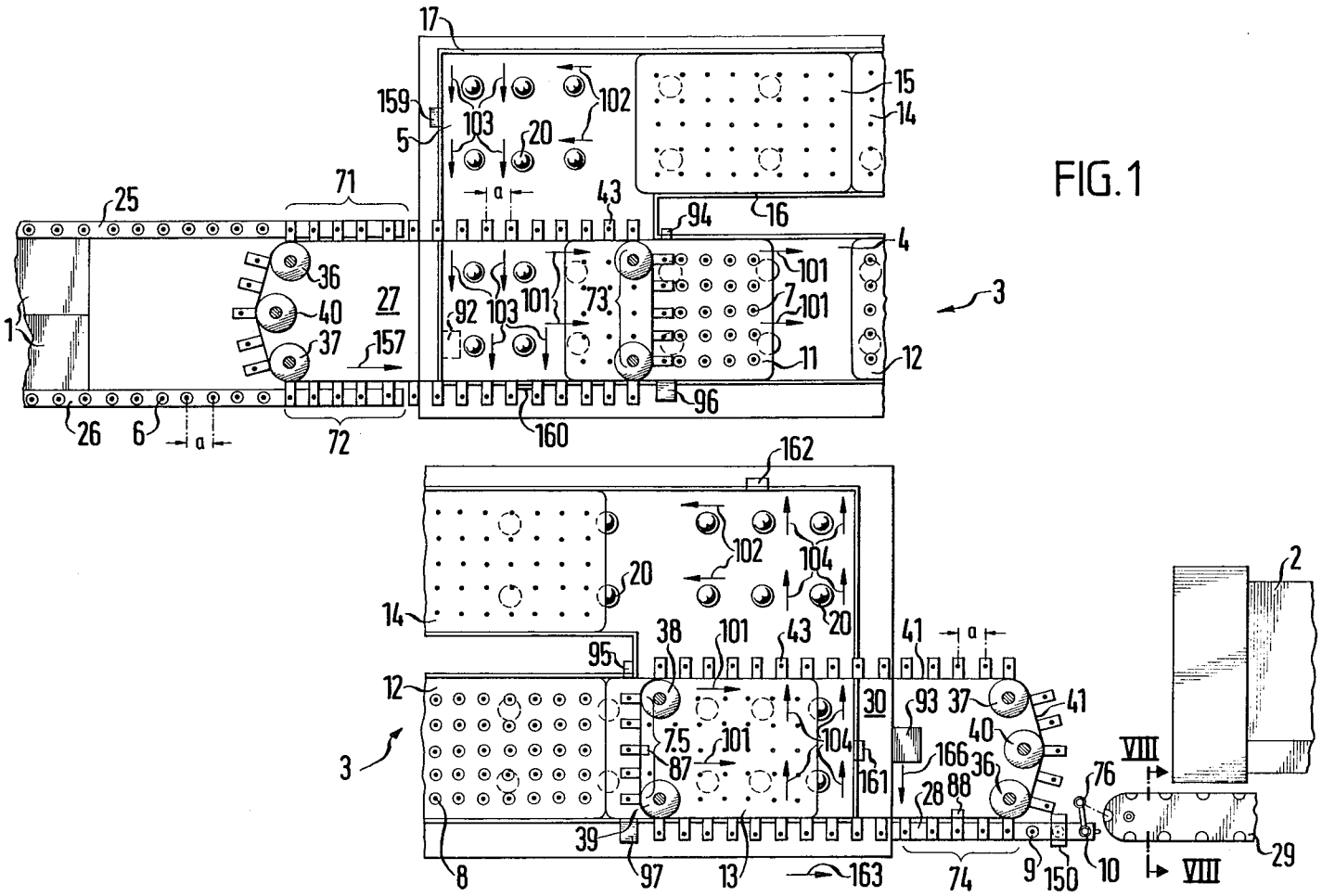
FIG. 1 is a fragmentary, diagrammatic, top-plan view of a bobbin transporting device.

Referring now to the figures of the drawings in detail and first, particularly, to FIG. 1 thereof, there is seen a bobbin transporting device, which is designated as a whole with reference numeral 3 and is provided for the transport of bobbins or cops from a two-sided spinning machine 1 to an automatic winding machine 2. The left half of the bobbin transporting device 3 is shown at the top of FIG. 1 and the right half is shown at the bottom. It must be visualized that the right half is at the right of and attached to the left half, as indicated in phantom.

The transport path of the bobbin transporting device is formed of a slide surface 4 for transport and a slide surface 5 for return of a tray or pallet 11 to 15, which can be loaded with upright positioned bobbins 7, 8. The ends of the slide surfaces 4 and 5 are connected with each other, so that circulation of the trays is made possible. The interconnected slide surfaces 4 and 5 are bordered by inner and outer guide plates 16, 17, respectively.

Figure 2:
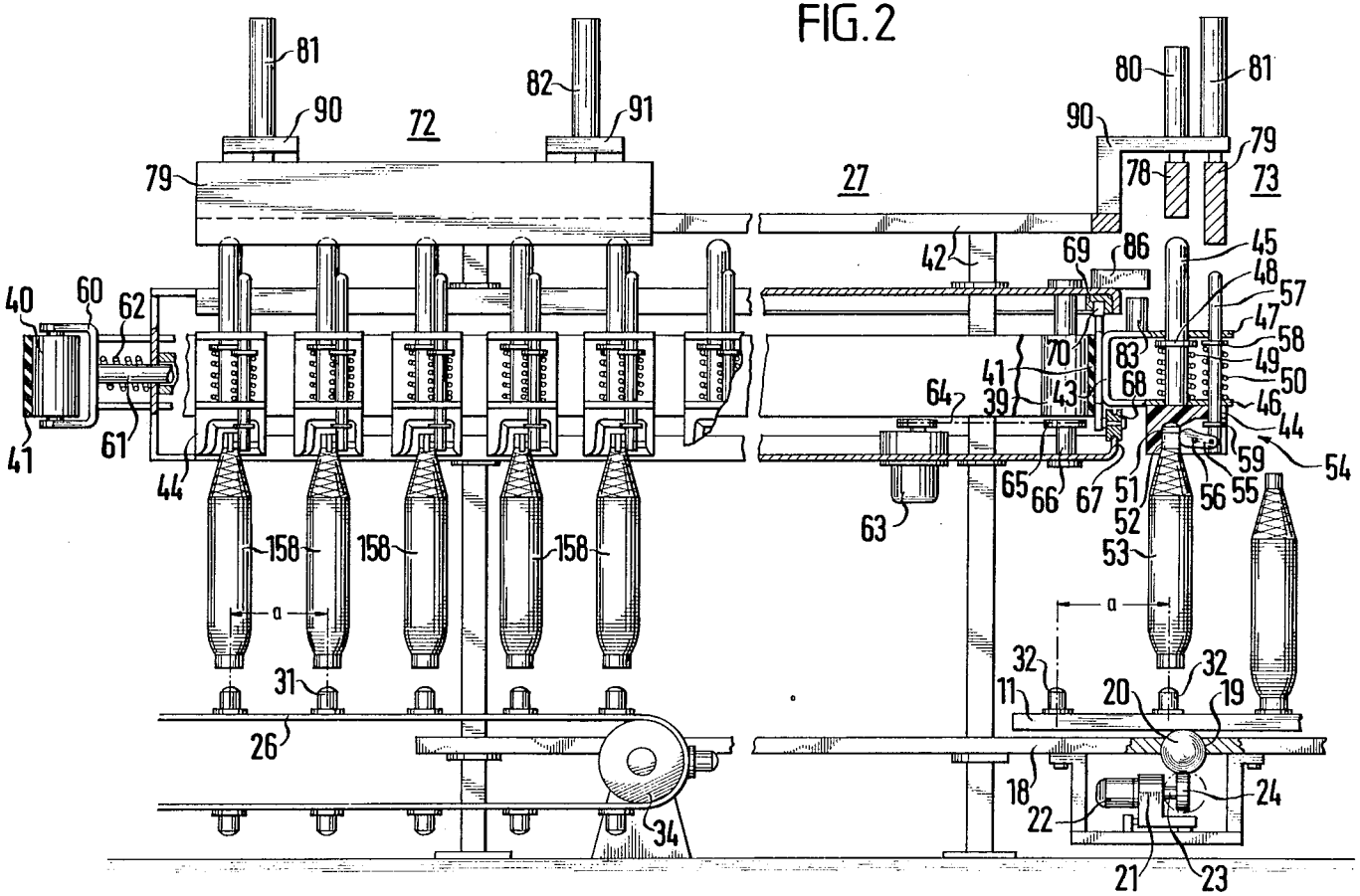
FIG. 2 is a fragmentary, side-elevational view of a tray loading device.

According to FIG. 2, circular holes 19 are provided in a flat bottom 18 of the slide surfaces 4 and 5, in which spheres 20 are rotatably supported. Under each sphere 20 there is a drive device 21 with a small short circuit resistant or spark proof motor 22, having a shaft 23 that carries a drive disc 24 for the sphere 20.

The drive directions of forty-four drive devices 21 are indicated in FIG. 1 by small arrows.

According to FIG. 1, a tray or pallet loading device 27 which is disposed at the spinning machine 1, works in conjunction with two bobbin collecting conveyors 25 and 26. Two synchronized bobbin conveyors 28 and 29 are provided at the automatic winding machine 2. A tray or pallet unloading device 30 works together with the bobbin conveyor 28.

The two bobbin collecting conveyors 25 and 26 are constructed in the form of conveyor belts. For example, according to FIG. 2, the conveyor 26 has mounting pins 31 for the bobbins, which are spaced apart by a center distance a. The conveyor belt is deflected by a deflection roller 34.

The bobbin conveyor 28 is also a conveyor belt, which runs over deflection rollers, one roller 35 being shown in FIG. 6. The conveyor belt 28 also carries mounting pins 33 with a center distance a.

The tray unloading devices 27 and 30 are similarly constructed, but are designed with their sides reversed. Both devices will be explained further using the tray unloading device 27 as an example.

Figure 3:
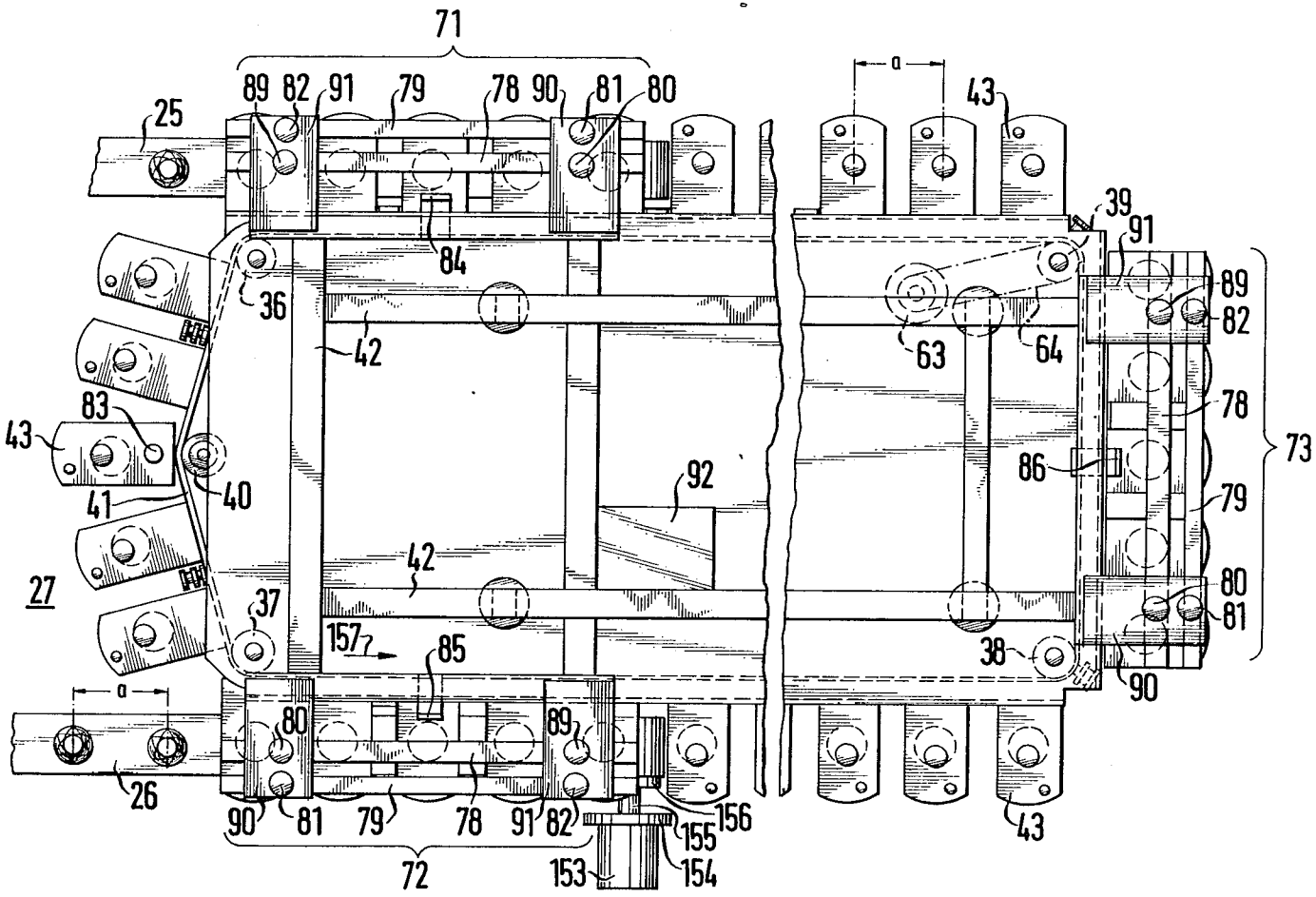
FIG. 3 is a fragmentary, top-plan view of the tray loading device of FIG. 2.

According to FIGS. 2 and 3, the tray unloading device 27 includes a flexible, tension-proof endless band or belt 41, which stands on its edge, is conducted over deflection rollers 36 to 39 and is provided with a tension roller 40. A machine frame 42 carries the deflection rollers, the tension roller and the other parts of the tray unloading device.

Uniformly shaped traverses or cross pieces 43 are fastened to the band 41 and spaced apart at the center spacing distance a of the mounting pins 32 of the trays 11 to 15. The locations at which these traverses are fastened to the band lie vertically on top of each other, so that the deflection of the band at the deflection points is not affected. Each traverse 43 supports a bobbin carrying head 44 which can be raised or lowered. The bobbin carrying head 44 sits at the lower end of a vertical rod 45. The rod 45 extends through guide bushings in a lower leg 46 and in an upper leg 47 of the traverse 43. The rod 45 has a collar 48, against which a compression spring 49 presses, so that the bobbin carrying head 44 presses from the bottom against the lower leg 46 of the traverse 43 under the action of the spring 49.

Figure 4:
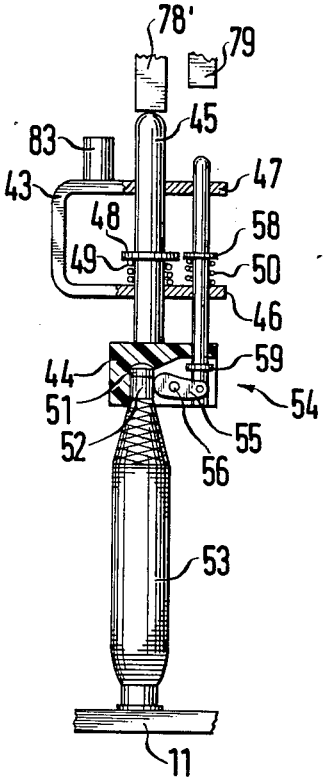
FIGS. 4 and 5 are enlarged, fragmentary, side-elevational views of the tray loading device.
Figure 5:
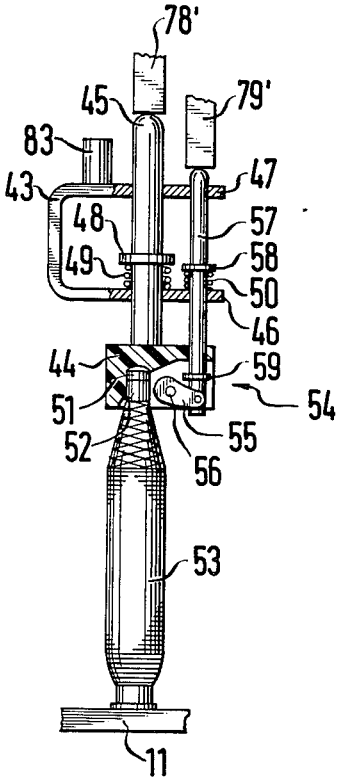

The bobbin carrying head 44 has an opening 51 for accepting the point or tip of a tube or sleeve of the bobbin, such as the point of the tube 52 of a bobbin 53, shown in FIGS. 2, 4 and 5.

The bobbin carrying head 44 is provided with a tube or sleeve clamping device 54. The tube clamping device 54 has a clamping lever 55, which pivots about an axis 56 and clamps the point 52 of the tube from the side. The clamping lever 55 articulates with a vertical rod 57. The rod 57 has three guide points, one in the bobbin carrying head and two in the traverse 43.

The rod 57 also has a collar 58, which is loaded by a compression spring 50 that sits on the leg 46. The spring 50 always holds the clamping lever 55 in the clamped position. A second collar 59 limits and fixes the position of the clamping lever 55.

The tension roller 40 is supported on a fork 60. The fork 60 sits at the end of a rod 61 which can slide on the machine frame 42 and is loaded by a compression spring 62.

The deflection roller 39 can be driven by a drive motor 63, which is connected by a chain 64 to a sprocket wheel 65 which sits on a shaft 66 of the deflection roller 39, as seen in FIG. 2.

In order to relieve the load on the endless band 41, each traverse 43 is provided at the bottom thereof with a roller 68 which runs on a rail 67, and at the top thereof with a guide element 70 in the form of a simple pin which engages in a guide rail 69. The rails 67 and 69 are interrupted in the vicinity of deflection regions of the band so that there are only straight rail sections. The individual traverses 43 are therefore not guided at the deflection region, but this is permissible with small bobbins, because the adjacent traverses are still guided.

The endless band 41 of the tray loading device 27 in the illustrated embodiment is advanced in cycles of five center distances a from a bobbin receiving station 71 or 72, respectively, which is disposed above the conveyor 25 or 26, respectively, of the spinning machine 1, to a bobbin discharge station 73, which is disposed above the slide surface 4. The band 41 of the tray unloading device 30 can move from a bobbin receiving station 75 which is disposed above the slide surface 4, to a bobbin discharge station 74 which is disposed above the bobbin conveyor 28, which serves as a bobbin receiving device.

As shown in FIG. 6, the bobbin conveyor 28 can move in steps adjusted according to the center distance a of its mounting pins 33 which pass a bobbin transfer device 76. The bobbin transfer device 76, according to FIGS. 6 and 7, transfers the bobbins individually to a bobbin receiving element 77 of the second bobbin conveyor 29 of the automatic winding machine 2.

At the bobbin receiving stations 71, 72, 75 and at the bobbin discharge stations 73 and 74 according to FIG. 2, shifting rails 78 are provided for five adjacent bobbin carrier heads 44 and shifting rails 79 are provided for the associated bobbin clamping devices 54. With the aid of pneumatic shifting devices 81 and 82, the shifting rails 79 can be individually lowered in sequence from the rest position shown in FIG. 2 to positions 78' and 79' which are shown in FIG. 5. The lowering of shifting rail 78 results in a lowering of the bobbin carrier head 44 and the lowering of shifting rail 79 causes the tube clamping device 54 to open.

The total number of the traverses 43 which are fastened to the endless band 41 should be divisible by five in the illustrated embodiment. This is practical for several reasons, because the belt is always advanced over the distance of five center spacings of the mounting pins, i.e. five center spacings of the traverses 43. In order to make this possible, the fifth traverse always carries a shift pin 83, according to FIGS. 2 and 3. The shift pins 83 acts on a proximity switch at the bobbin receiving stations 71, 72, 75 and at the bobbin discharge stations 73 and 74. If the shift pins 83 are made of iron, the proximity switch can be an electromagnetic device. According to FIG. 3, proximity switches 84 and 85 are assigned to the bobbin receiving stations 71 and 72, while a proximity switch 86 is assigned to the bobbin discharge station 73. According to FIG. 1, a proximity switch 87 is assigned to the bobbin receiving station 75 and a proximity switch 88 belongs to the bobbin discharge station 74.

FIG. 3 shows that the disposition of the shifting rails 78 and 79 is the same at the bobbin receiving stations and at the bobbin discharge stations. At each position, the pneumatic shifting devices 80 and 89 of the shifting rails 78 and the pneumatic shifting devices 81 and 82 of the shifting rails 79 are fastened to traverses or cross pieces 90, 91, respectively, which are connected to the machine frame 42.

According to FIG. 1, the number of traverses 43 fastened to a band 41 is divisiable by five. Since every fifth traverse element 43 has a shifting pin 83, the layout of the bobbin receiving stations or bobbin discharge stations can be carried out in such a way that as the band 41 advances five center distances a, there is always a shifting pin under a proximity switch of a bobbin receiving or bobbin discharge station.

Functional connections are provided from a central control unit 92 to the proximity switches 84, 85 and 86, while functional connections are provided from the proximity switches 87 and 88 to a central control unit 93. The central control unit 92 reacts to control commands from the proximity switches 84, 85 and 86 and controls the shifting rails 78 and 79 of the bobbin receiving stations 71 and 72 as required, in dependence on whether or not the bobbin collecting conveyor 25 or 26 has to be emptied at that moment. The shifting rails 78 and 79 of the bobbin discharge station 73 are controlled by the central control unit 92, but in conjunction with a light gate 94, which is also functionally connected to the central control device 92. The light gate 94 sends a signal to the central control unit 92, if it detects a row of mounting pins 32 on a tray which is not filled with bobbins. The central control unit 92 subsequently activates the pneumatic shifting devices 80, 89 of the bobbin discharge station 73 until, according to FIG. 2 for example, tbe bobbin 53 and with it all five bobbins in the row are positioned on the mounting pins 32 of the tray 11, for example. After a period of time has elapsed which is required to perform this operation, the central control unit 92 activates the pneumatic shifting devices 81 and 82 of the bobbin discharge station 73, so that the shifting rail 79 is lowered and releases the tube sleeve clamping devices 54. According to a timing program, the shifting rail 78 is then moved back and after a small delay the shifting rail 79 is moved back, so that the bobbins are no longer carried by the bobbin carrier heads 44.

A functional connection is provided from the light gate 94 to an arresting device 96 shown in FIG. 1, which serves the purpose of retaining the tray which is at that moment in the bobbin discharge station 73, until a row of mounting pins is filled with bobbins.

According to FIG. 9, each tray has notches 98 formed in the edges thereof, into which a plunger 99 of an electro-magnet 100 of the arresting device 96 can engage, if the electro-magnet 100 is turned on by a pulse from the light gate 94. The electro-magnet 100 is also deactivated by the central control unit 92, after deactivating commands have been simultaneously given to all four pneumatic setting devices of the bobbin discharge station 73.

For example, after the arresting device 96 has been released, according to FIG. 1 the tray 11 can move in the direction of arrows 101, because all together fourteen drive devices 21, which are disposed below the plane of the slide surface 4, operate to transport the released trays toward the right side.

At the same time, the central control unit 92 turns on the drive motor 63, in order to advance the band 41 five center distances a. After the band has advanced the five center distances a, the proximity switches 84, 85 and 86 are again activated, so that the central control unit 92 first stops the drive motor 63 and then the above-described work cycle begins again.

According to FIGS. 7 and 8, the bobbin conveyor 29 which supplies the automatic winding machine 2 with bobbins, is provided with bobbin carriers 107 carrying bobbins 105 and 106. The bobbin carriers 107 are formed of elongated, angular sheet metal strips, each of which is connected to a chain link 108 of a conveyor chain 109 shown in FIG. 7, each of which is provided with a bobbin receiving element 77 for a foot 120 of the tube or sleeve, such as the tube of the bobbin 106 according to FIG. 6, and each of which is also provided with a flexible or elastic clamping element 121 for the head 122 of the tube or sleeve.

According to FIGS. 6 and 8, in order to take the weight off the chain, each bobbin carrier 107 is provided with a roller 123, which rolls on a rail 124. Below the bobbin receiving element 77, each bobbin carrier 107 has an additional roller 125, which is guided in a rail 126 as shown in FIG. 8. Vertical supports 127 standing on the floor are connected to the rails 124 and 126 in order to form a stable structure.

Sprocket wheels are provided at the deflection points of the bobbin transporters 29. A sprocket wheel 128 thereof can be driven by a drive motor 129.

The bobbin transfer device 76 is provided with a gripper arm 130, which can swing horizontally and which is fastened to a vertical piston rod 131 of a pneumatic lifting device 132. The pneumatic lifting device 132 can be rotated through an angle $\alpha$ around a horizontal axis 134 by a setting motor 133. An articulating point 135 of pincers 136 is fastened to the gripper arm 130; the pincers 136 can be operated by a piston rod 137 of a pneumatic cylinder 138. The pincers 136 carry two gripper jaws 139, 140 with which the bobbins 106 can be gripped, as shown in FIG. 7. After the bobbin 106 has been gripped, the piston rod 131 can be moved upward and the pneumatic lifting device 132 is moved through the angle $\alpha$, so that the bobbin 106 can snap-in between the bobbin receiving element 77 and the clamping element 121 of a bobbin carrier 107. The pneumatic cylinder 138 then operates the pincers 136, in order to open the gripper jaws 139, 140, after which the arm can swing back to pick up another bobbin.

According to FIG. 7, a bracket 141 carries a geared motor 142, having a shaft 143 which is connected to the deflection roller 35 of the bobbin transporter 28. According to FIG. 6, functional connections 144 to 148 are provided between a control unit 149 and the drive motor 129, the setting motor 133, the pneumatic device 132, the motor 142, and a bobbin preparation station, which is designated with reference numeral 150 as a whole. A suction head 151 of the bobbin preparation station 150 can be lowered to a position 151' in order to search for a thread end on the surface of a bobbin, such as the surface of a bobbin 152 and to bring the thread end into the interior of the tube or sleeve. However, in the illustrated condition of the machine the bobbin preparation station 150 is not used, since it is required only in certain cases.

The control unit 149 assures the timed bobbin transfer from the bobbin conveyor 28 to the bobbin transporter 29. This will be further explained below.

The operation of the device of the invention proceeds as follows: It is assumed that the bobbins 6 which are on the bobbin collecting conveyor 26, are to be moved automatically to the bobbin transporter 29 and are to be inserted into the bobbin carrier 107 thereof.

A step-by-step switch in the central control unit 92 has stopped the bobbin collecting conveyor 26 through a non-illustrated functional connection which leads to a geared motor 153, after the conveyor has advanced five center distances a. According to FIG. 3, the geared motor 153 is fastened to a bracket 154. A shaft 155 of the motor 153 carries a forward deflection roller 156 of the bobbin collecting conveyor 26.

According to FIGS. 1 and 3, the band 41 has also been advanced five center distances a, in the direction of an arrow 157.

At this point, five bobbins are positioned on the bobbin collecting conveyor 26, exactly below the five bobbin carrying heads 44 at the bobbin receiving station 72; these bobbins are removed or doffed in the following way:

The central control unit 92 supplies the pneumatic setting devices 80 and 89 with compressed air, so that the shifting rail 78 is lowered. The shifting rail 78 therefore acts on the rods 45 of all of the bobbin carrying heads 44, so that the bobbin carrying heads 44 are lowered over the points or tips of the tubes or sleeves and the tube clamping devices 54 are automatically opened by the receding motion of the clamping levers 55 against the force of the spring 50, but hold the tube sleeves securely clamped. Then the central control unit 92 moves the shifting rail 78 back to the starting position and all five of the bobbins are picked up or removed from the bobbin collecting conveyor 26. This moment during the operation of the device is shown in FIG. 2.

Simultaneous to the activation the shifting rail 78 located at the bobbin receiving station 72, the central control unit 92 also causes the shifting rail 79 of the bobbin discharge station 73 to operate.

Since bobbins are positioned on all of the traverses 43 between the bobbin receiving station 72 and the bobbin discharge station 73 according to FIG. 2, as viewed in the direction of the arrow 157, the bobbins 53 can be lowered onto the mounting pins 32 of the tray 11 by lowering the bobbin carrying heads 44. After this is done, the central control unit 92 causes the downward motion of the shifting rail 79 at the bobbin discharge station 73, so that the tube clamping devices 54 are opened. Then, the control unit 92 causes the simultaneous and uniform retraction of the two shifting rails 78, 79 of the bobbin discharge station 73. The bobbin carrying heads 44 therefore return to their starting positions, without the bobbins. The retraction of the shifting rail 79 can be delayed.

During this entire time, the light gate 94 ensures that the arresting device 96 remains energized. After the bobbins are all on their pins, the light gate releases the arresting device 96 with some time delay, so that the tray 11 can advance one row to the right in the direction of the arrows shown in FIG. 1. Then, the light gate 94 is triggered again, because it registers the arrival of the next row of mounting pins. At that point, the arresting device 96 is engaged again.

The acceptance of bobbins by the bobbin collecting conveyor 26 and the discharge of the other five bobbins onto the tray 11 takes place simultaneously.

The central control unit 92 now turns on the motor 63, so that the band can advance five center distances a in the direction of the arrow 157, until the proximity switches 84 and 86 respond to the next following shift pins 83. The above-described work cycle is then repeated.

The motion of the tray 11 and of the other trays in the transport direction takes place as follows: The spheres of the drive devices 21 of the slide surface 4 which rotate in the direction of the arrows 101 continuously operate, so that a tray can immediately advance after it has been released.

Under the slide surface 5 there are also fourteen drive devices 21, having spheres which rotate in the direction of the arrows 102, i.e. in the direction opposite to the arrows 101. For example, if the tray 14 or the tray 15 has reached the slide surface 5, it is automatically transported back in the direction of the arrows 102, without being stopped by an arresting device.

If the tray 15 according to FIG. 1 arrives at an end switch 159 during its travel, eight drive devices 21 are turned on, so that the spheres thereof rotate in the direction of the arrows 103, whereby the tray 15 is moved in the direction of the arrows 103. If the tray 11 is still in its way, as shown in FIG. 1, the tray 15 can only travel until it hits against the tray 11. The abovementioned drive devices therefore remain energized and the spheres 20 slip on the drive discs 24 or the rotors of the small short circuit resistant motors 22 stop.

After the tray 11 has cleared the way for the tray 15 during the continued loading operation, the tray 15 finally reaches the end switch 160, which again turns off the above-mentioned drive devices 21. The continuously running drive devices 21 of the slide surface 4 attempt to move the tray toward the right, as shown in FIG. 1, unless the arresting device 96 prevents this.

Fully loaded trays travel on the slide surface 4 from the bobbin discharge station 73 to the bobbin receiving station 75. At the station 75 according to FIG. 1, the tray 13 is stopped by an arresting device 97, which is controlled by a light gate 95. The light gate 95 simultaneously controls the central control unit 93 which in turn controls the acceptance of a row of bobbins at the bobbin receiving station 75 and the discharge of a row of bobbins at the bobbin discharge station 74, in the above-mentioned manner. The band 41 of the tray unloading device 30 then advances five center distances a in the direction of an arrow 163, in order to accept the next batch of bobbins and in order to discharge another batch.

At the bobbin discharge station 74, the bobbins are transferred to the bobbin conveyor 28. After five bobbins are discharged to the bobbin conveyor 28, the central control unit 93, which activates the control device 149 through a functional connection 166, subsequently initiates the following work cycle five times:

The pneumatic device 138 is activated through a functional connection 165 and retracts the piston rod 137 to close the jaws 139, 140 of the pincers 136 around the bobbin 106. Then the pneumatic device 132 is activated through the functional connection 146 in order to move out the piston rod 131, so that the bobbin 106 is lifted from the bobbin conveyor 28. Then the setting motor 133 is activated through the functional connection 145, in order to swing the pneumatic device around the angle $\alpha$ with the gripper arm 130. During this movement, the bobbin 106 snaps-in between the bobbin receiving element 77 and the clamping element 121 of the bobbin carrier 107, as indicated in FIG. 6. The pneumatic device 138 is then activated through the functional connection 165, in order to move the piston rod 137 in the opposite direction for opening the gripper jaws 139, 140 which hold the bobbin 106. The setting motor 133 is subsequently started in reverse to return the gripper arm 130 to its starting position. Finally, the pneumatic device 132 is retracted through the functional connection 146. Then the drive motor 142 is turned on through the functional connection 147, until the bobbin conveyor 28 has advanced one center distance a. At the same time, the drive motor 129 is energized through the functional connection 144, in order to turn the sprocket 128 four teeth 168 ahead in the direction of an arrow 167, to bring the next bobbin carrier 107 into the bobbin receiving position.

This cycle is repeated five times and during this period the band 41 of the tray unloading device 30 advances five center distances a.

The bobbin conveyor 28 transfers the bobbins 106, 152, 9, 164 and an additional bobbin to the bobbin transporter 29 in sequence, so that there is again room for five additional bobbins on the bobbin conveyor 28 at the bobbin discharge station 74.

If the automatic winding machine 2 cannot accept the bobbins fast enough, the control device 149 adjusts the bobbin transfer speed to the forward velocity of the bobbin conveyor 29, i.e. the transfer operates more slowly. The central control unit 93 initiates a new loading and unloading cycle only after it receives a signal through the functional conenction 166 that a series of five bobbins has been transferred.

According to FIG. 1, the tray 13 is not yet fully emptied. After the last row of bobbins has been unloaded and after the tray 13 has been released from the arresting device 97, the drive devices 21 of the slide surface 4 transport the tray 13 against an end switch 161, which energizes the eight drive devices 21 that are located furthest to the right and causes the spheres thereof to rotate in the direction of the arrows 104. The tray 13 is therefore moved in the direction of the arrows 104, until it hits another end switch 162, which again turns the above-mentioned drive devices. The continued transport in the direction of the arrows 102 is effected by the continuously running fourteen drive devices and spheres 20 of the slide surface 5. According to FIG. 6, if necessary during the unloading of the bobbin conveyor 28, the bobbin preparation station 150 can be activated through the functional connection 148, in order to prepare the bobbin 152 for the winding operation, such as by sucking its thread end into the tube or sleeve. However, as mentioned above, the bobbin preparation station is not being used as shown.

In the alternate configuration of a tray or pallet loading device 169 according to FIGS. 10 to 13, a tray 170, which in this case is provided with rollers 171, 172, can be moved to the bobbin collecting conveyor 26 from the side. This bobbin collecting conveyor has been shown in FIGS. 1 and 3, but in this case is disposed at a one-sided spinning machine. In this embodiment, the bobbin collecting conveyor 26 conveys especially large bobbins 173, 174. These bobbins have to be lifted from the mounting pins 33 and placed onto bobbin mounting pins 175 of the tray 170.

The tray loading device 169 includes a travelling carriage 177, which is driven by a motor 176. The carriage 177 has two machine frames 178, 179, which are interconnected by a carrier 180. Two shafts 181, 182 are supported in the two machine frames 178, 179 of the carriage 177. The shaft 181 is provided with two rollers 183, 184. Two additional rollers 185, 186 are supported on the shaft 182, in such a way that they can rotate freely on the shaft 182.

The four rollers carry the carriage 177. The rollers 183 and 185 rest on a horizontal carrier 187 and the rollers 184 and 186 rest on a horizontal carrier 188. The carriers 187, 188 rest on stands or supports 189, 190 and traverses 191.

A drive shaft 192 of the drive motor 176 carries a gear 193, which engages in a gear rack 194 on the carrier 187.

The shaft 182 has eight arms, of which only arms 195 and 196 are visible. Each arm carries a bobbin carrier head, of which only bobbin carrier heads 197 and 198 are visible.

The shaft 182 is provided with a lever 199 through which a pneumatic device 200 can be rotated, so that the arms 195 and 196 can be moved in the direction of the curved arrow 201 to an approximately horizontal position.

In FIGS. 12 and 13 the bobbin carrier head 197 is shown in sectional views. Similar to the other bobbin carrying heads, the head 197 is provided with a controllable tube or sleeve clamping device 202. The tube clamping device 202 is formed of a pneumatic device, with a piston rod 203 which is provided with a clamping block 204. The bobbin carrying head 197 is provided with an annular, horizontal recess 205. The clamping block 204 also has a recess 206. The recesses serve the purpose of protecting an upper winding 207 at a point 208 of the tube or sleeve of the bobbin 173, as the point of the tube or sleeve is clamped.

The loading, such as of the row in the back of the tray 170, is performed in the following way:

The pneumatic device 200 lifts the lever 199, while the carriage 177 is in its forward most position according to FIG. 10. The arms 195, 196 are therefore lowered in the direction of the arrow 201, so that the bobbin carrying heads 197, 198 are positioned above the tips of the tube sleeves, such as over the last eight bobbins standing on the bobbin collecting conveyor 26. The tube clamping devices 202 are subsequently supplied with compressed air through flexible lines 209, 210, so that the arms 195, 196 move into a horizontal position. Then the drive motor 176 is turned on and provides only the number of revolutions required to bring the carriage into the position 177'. Then the pneumatic device 200 lifts the lever 199 again to lower the arms 195, 196. The feet or lower ends of the tubes or sleeves are therefore placed over the bobbin mounting pins 175 of the rear row of the tray 170. The tube clamping devices 202 are then supplied with compressed air, so that the clamping blocks 204 are released from the tube or sleeve tops. Then the lever 199 is again lowered by the pneumatic device, so that the arms 195, 196 again move into the horizontal position. The drive motor 176 is then shifted to reverse operation and makes exactly the same number of revolutions it made previously in the forward mode. Then the drive motor 176 is stopped. If the bobbin collecting conveyor 26 has meanwhile advanced by eight mounting pin spaces, the tray loading cycle can begin again. During this second tray loading operation, the carriage would not travel to the position 177', but only to a position which is moved back by the center distance a.

After the tray loading operation has been repeated four times, the tray 170 is filled and it can now proceed in the direction of an arrow 211 to the automatic winding machine.

The invention is not limited to the illustrated and described embodiments which were used as examples. For instance, the trays can be driven by rollers, belts or bands instead of the spheres.

The foregoing is a description corresponding in substance to German application No. P 35 18 906.1, filed May 25, 1985, the International priority of which is being claimed for the instant application, and which is hereby made part of this application. Any material discrepancies between the foregoing specification and the aforementioned corresponding German Application are to be resolved in favor of the latter.

I claim:

1. Bobbin transporting device for transporting bobbins from a spinning machine to an automatic winding machine, comprising at least one bobbin collecting conveyor disposed at the spinning machine, trays for accomodating bobbins in an upright position, a transport path for moving said trays back and forth between the spinning machine and the automatic winding machine, a tray loading device disposed at the spinning machine for loading said trays from said at least one bobbin collecting conveyor at the spinning machine, at least one synchronized bobbin conveyor disposed at the automatic winding machine, and a tray unloading device for unloading bobbins from said trays to said at least one bobbin conveyor, at least one of said tray loading and unloading devices including a strong, flexible endless band standing on edge, traverses fastened to said endless band and mutually spaced apart at said given center distance, bobbin carrying heads each being disposed on a respective one of said traverses, means for raising and lowering said bobbin carrying heads, tube clamping devices each being disposed on a respective one of said traverses, and means for releasing bobbin tubes from said tube clamping devices.

2. Bobbin transporting device according to claim 1, wherein said transport path includes one slide surface for transporting said trays in one direction and another slide surface for returning said trays.

3. Bobbin transporting device according to claim 2, including at least one drive device for said trays at said transport path.

4. Bobbin transporting device according to claim 2, including at least one drive device for said trays at said tray loading device.

5. Bobbin transporting device according to claim 2, including at least one drive device for said trays at said tray unloading device.

6. Bobbin transporting device according to claim 1, wherein said at least one bobbin collecting conveyor at the spinning machine, said at least one synchronized bobbin conveyor and said trays all have bobbin mounting pins disposed thereon being mutually spaced apart by said given center distance.

7. Bobbin transporting device according to claim 6, wherein at least one of said tray loading and unloading devices includes at least one tray pushing device, and means for controlling said pushing device according to said given center distance.

8. Bobbin transporting device according to claim 6, wherein at least one of said tray loading and unloading devices includes at least one tray arresting device, and means for controlling said arresting device according to said given center distance.

9. Bobbin transporting device according to claim 1, including rails and means for relieving load from said endless band in the form of rollers each being disposed at the bottom of a respective one of said traverses for running on one of said rails, and guide elements each being disposed at the top of a respective one of said traverses for engaging another of said rails and preventing tipping.

10. Bobbin transporting device according to claim 1, wherein said transport path includes one slide surface for transporting said trays in one direction and another slide surface for returning said trays and said at least one synchronized bobbin conveyor is a bobbin receiving device, and including at least one first bobbin receiving station disposed above said at least one bobbin collecting conveyor at the spinning machine, a first bobbin discharge station disposed above said one slide surface, a second bobbin receiving station disposed above said one slide surface, and a second bobbin discharge station disposed above said bobbin receiving device, and at least one of said tray loading and unloading devices includes means for moving said endless band thereof in steps equal to said given center distance from one of said bobbin receiving stations to one of said bobbin discharge stations.

11. Bobbin transporting device according to claim 10, wherein besides said bobbin receiving device, said synchronized bobbin conveyor also includes an additional bobbin conveyor having bobbin receiving elements, and including a bobbin transfer device for individually transferring bobbins from said bobbin receiving device to said bobbin receiving elements, and means for moving said bobbin receiving device past said bobbin transfer device in steps equal to said given center distance.

12. Bobbin transporting device according to claim 11, wherein said additional bobbin conveyor supplies bobbins to winding stations of the automatic winding machine, and said additional bobbin conveyor includes a conveyor chain having chain links and bobbin carriers connected to said chain links, said bobbin carriers each including one of said bobbin receiving elements for a foot of a bobbin tube and a flexible clamping element for a top of a bobbin tube.

* * * * *